US011932458B2

(12) United States Patent
Weyrauch

(10) Patent No.: US 11,932,458 B2
(45) Date of Patent: Mar. 19, 2024

(54) CLOSING RING CLOSURE DEVICE

(71) Applicant: August Berger Metallwarenfabrik GmbH, Berg (DE)

(72) Inventor: Detlev Weyrauch, Kreuzau (DE)

(73) Assignee: AUGUST BERGER METALLWARENFABRIK GMBH, Berg (DE)

( * ) Notice: Subject to any disclaimer, the term of this patent is extended or adjusted under 35 U.S.C. 154(b) by 622 days.

(21) Appl. No.: 17/129,814

(22) Filed: Dec. 21, 2020

(65) Prior Publication Data

US 2021/0188496 A1 Jun. 24, 2021

(30) Foreign Application Priority Data

Dec. 23, 2019 (DE) ..... 202019005272.0

(51) Int. Cl.
*B65D 45/34* (2006.01)

(52) U.S. Cl.
CPC ..... *B65D 45/345* (2013.01)

(58) Field of Classification Search
CPC ..... B65D 45/00; B65D 45/34; B65D 45/345; B65D 45/16; B65D 45/18; B65D 45/20; B65D 45/22; B65D 45/24; B65D 45/06
USPC ..... 292/256
See application file for complete search history.

(56) References Cited

U.S. PATENT DOCUMENTS 3,637,257 A * 1/1972 Uncapher ..... B65D 45/345 292/256.69
2012/0267373 A1* 10/2012 Starr ..... E05C 3/043 220/319

FOREIGN PATENT DOCUMENTS

DE 8403437 U1 4/1984
DE 202013000452 U1 1/2013
DE 202013000452 U1 * 3/2013 ..... B65D 45/345

* cited by examiner

*Primary Examiner* — Nathan Cumar
(74) *Attorney, Agent, or Firm* — DITTHAVONG, STEINER & MLOTKOWSKI

(57) ABSTRACT

The present invention relates to a closing ring closure device for a closing ring with a closing lever and a one-piece or two-piece traction bracket, each of which are pivotably mounted by means of pivot bearings on a pivot bearing base on the closing ring side, wherein the traction bracket and the closing lever are pivotably connected to one another by means of a further pivot bearing. For automation in production technology and for the use of mechanical closing ring closure devices, e.g. on automatic filling lines, it is very advantageous if the two components closing lever and traction bracket are provided with special constructive means which are designed in a mutually coordinated functional mode between the two components as a snap-fit device for fixing the closing ring closure device in wide-open closing lever position.

10 Claims, 5 Drawing Sheets

CLOSING RING CLOSURE DEVICE

RELATED APPLICATION

Figure 1:
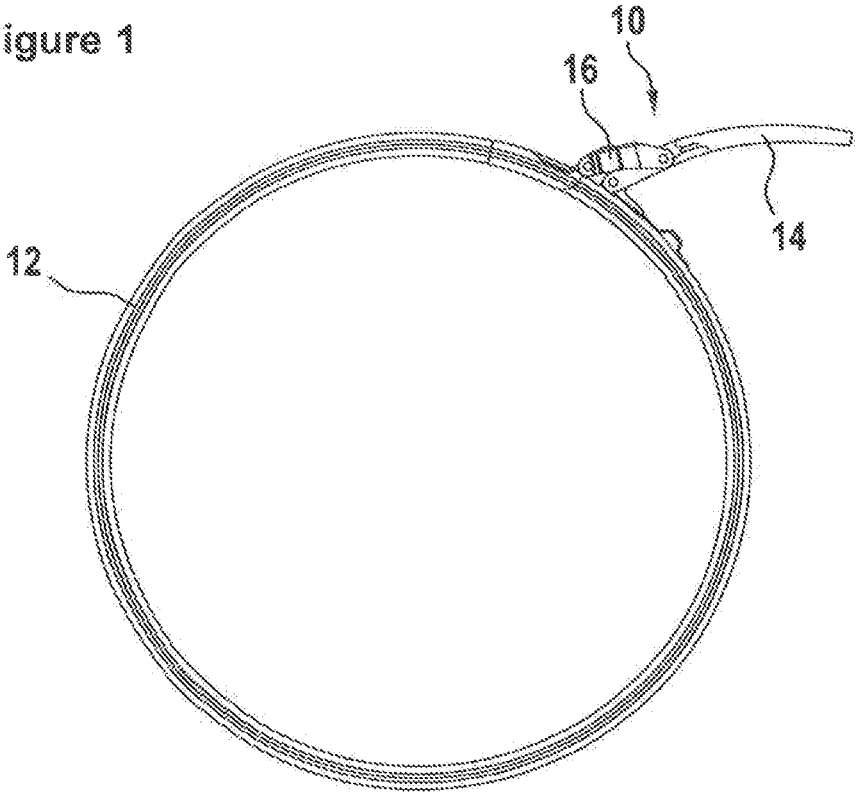

This application claims benefit over German Application No. 20 2019 005 272.0 filed Dec. 23, 2019, the contents of which are hereby incorporated herein in their entirety.

The present invention relates to a closing ring closure device for a closing ring with a closing lever and a one- or two-piece traction bracket, each of which are mounted pivotably via a pivot bearing on a pivot bearing base on the closing ring, wherein the traction bracket and the closing lever are pivotably connected via another common pivot bearing. The present invention further relates to a closing ring with said closing ring closure device.

Closing rings usually have a U-shaped or trapezium-shaped profile, in which a flat or rounded center piece connects an upper and a lower closing ring arm. At least one of the two closing ring arms is designed to run at an angle, and often both closing ring arms are designed to run at an angle, with the distance between the two closing ring arms increasing inwards towards the center of the closing ring. In special embodiments of closing rings, an upwardly or/and downwardly angled collar-shaped flange edge may adjoin the upper or/and lower closing ring arm.

The closing ring closure device bridges the two ends of the closing ring with the closing ring-side pivot bearing base of the closing lever being permanently welded onto one end of the closing ring and the closing ring-side pivot bearing base of the traction bracket being permanently welded onto the other end of the closing ring. When the closing lever is closed, the closed closing ring has its smallest diameter, and when the closing lever is opened, the open closing ring has its largest diameter. The largest diameter of the opened closing ring is required when putting on or taking off the closing ring from the cover flange rim and drum body flange rim, for this purpose the closing lever must be held by hand in fully opened position. The smallest diameter of the closed closing ring with the closing lever folded in is required for axial clamping and pressing together of the fitted drum lid with the drum lid seal onto the drum body opening or the drum body rim.

Closing rings with a closing ring closure device for the detachable fastening of a drum lid to a lidded drum are known in a wide variety of embodiments, for example from DE 20 2013 000 452 U1 (Berger). In the closing ring described therein, the closing lever is fixed in the closed position by constructive means in order to prevent the closing lever or the closing ring closure from opening accidentally or unintentionally. In the known state of the art, there are many other proposed solutions for securing or fixing the closed closing lever in the closed position.

Problem

However, the present invention is directed at a different problem. In the manufacture of closing rings, on the one hand the closing ring closure device with its two pivot bearing bases must be welded onto the two ends of the closing ring. Since the closing lever is connected to the traction bracket only by means of a pivot pin, and the closing lever and traction bracket are also pivotably mounted on the outside by means of pivot bearings on the two pivot bearing bases, this prefabricated component unit is a comparatively unstable system which is difficult to handle.

On the other hand, when opening a lidded drum, the closing lever of the closing ring must be brought into a wide open position and held manually in order to be able to lift the opened closing ring off the drum lid or lidded drum. When closing the lidded drum, the closing lever of the closing ring must again be held in a wide open position with the largest diameter and only then the opened closing ring can be placed over the edge of the fitted drum lid and the edge of the lidded drum and can be firmly closed.

It is the object of the present invention to simplify the handling of a closing ring closure device as a prefabricated component unit during further processing as well as to simplify the handling of a closing ring with welded-on closing ring closure device during the closing and opening of a lidded drum with drum lid and to enable further automation in closing ring production as well as in lidded drum closing machines.

This object is solved according to the invention in that the two components closing lever and traction bracket are provided with constructive means which are designed in a mutually coordinated functional mode between the two components as a snap-fit device for fixing the closing ring closure device in a wide open closing lever position.

As a constructive means, the closing lever or/and the traction bracket are provided with a special locking device which fixes the closing lever in a wide-open position at an opening angle of greater than 90°.

By fixing the closing ring closure device in a wide-open closing lever position by means of the locking device designed as a snap-fit device, the closing ring closure device can be handled much easier during further processing. As a prefabricated component unit, the closing ring closure device, which consists of four individual components each pivotably connected via pivot bearings, is now no longer an unstable chain of components, but with a defined rigid position it can be inserted into a supply magazine and then fed, for example, to an automatic welding machine for welding the pivot bearing bases to the closing ring blank. After completion of the welding process, the finished welded closing ring with locked closing ring closure device can be transported in wide-open closing lever position by an automatic gripping and conveying device to a lidded drum closing machine, where the wide-open closing ring is automatically placed on a lidded drum with drum lid and closed.

In a constructive embodiment of the invention, it is provided that the locking device is designed as a snap-fit device with a snap element and a latching element, wherein the snap element is arranged either on the traction bracket or on the closing lever and the latching element is arranged correspondingly opposite on the closing lever or on the traction bracket.

The mutual locking of the closing lever and the traction bracket results in a wide spread or wide opening of the closing ring closure device and thus makes it possible to store and transport this component group in a defined stable arrangement and to generally simplify and facilitate the handling of a closing ring provided with the closing ring closure device according to the invention.

In a specific embodiment of the invention, it is provided that the traction bracket or brackets have two parallel outer flanks facing each other, each of which is provided on its inner side with at least one protrusion directed towards the opposite outer flank and latching into a corresponding notch or recess in any of the outer sides of the side walls when the closing lever is in wide open position.

Particularly in the case of closing rings with a larger diameter, e.g. for 220 l lidded drums, the two parallel, opposing outer flanks of the traction brackets are interconnected via a common center piece and are formed as a one-piece component. This results in greater stability of the entire closing ring closure device.

In a further embodiment of the closing ring closure device, the snap-fit device arranged between the traction bracket and the closing lever is designed in such a way that, when the closing lever is in the wide open position, the snap element engages with the latching element, with the closing lever being fixed against the traction bracket at an opening angle of greater than 160°.

In the preferred embodiment of the closing ring closure device according to the invention, the traction bracket has short extensions on both sides beyond the pivot bearing C common to the closing lever, and said extensions each have indentations on the outside and, respectively, protrusions (latching cams) on the inside pointing inwards, wherein in the side walls of the closing lever corresponding recesses are provided on both sides, into which the protrusions can be snapped and latched opposingly (vis a vis) in a locking manner, when the closing lever is in wide open position.

When looking at a closing ring with closed closing ring closure, the closing lever rests on the closing ring and the opening angle is zero. When the closing ring closure is open, the closing lever is usually at right angles to the closing ring, i.e. the opening angle is about 90 degrees. The closing ring is now no longer under tension stress, but must still be opened further and held by hand to be placed on the drum lid or to be removed from the lid rim. Whereas, by locking the closing ring closure device in a wide-open position at an opening angle of the closing lever of greater than 160°, the closing ring can be easily removed from the edge of the drum or lid without the closing lever having to be held by hand all the time. At the same time, it is now possible to fully automatically place and close closing rings with a locked closing ring closure device in fully open position and with the largest possible diameter on drum lids of lidded drums in automated lidded drum closing systems.

In another preferred embodiment of the invention, the closing lever is equipped on its side opposite the pivot bearing C—at the same distance from pivot bearing C as the inwardly pointing protrusions (latching cams) on the extension of the traction bracket—on both sides with corresponding recesses in its side walls such that the protrusions on the extension of the traction bracket can be snapped and latched into the corresponding recesses in the side walls of the closing lever in a locking manner as a closure device for the closing lever, when the closing lever is in the completely closed position.

The recesses can also be designed as slotted holes, like the slotted holes already present in the closing lever for the known type of closure by help of a sealing eyelet on the closing ring.

Figure 2:
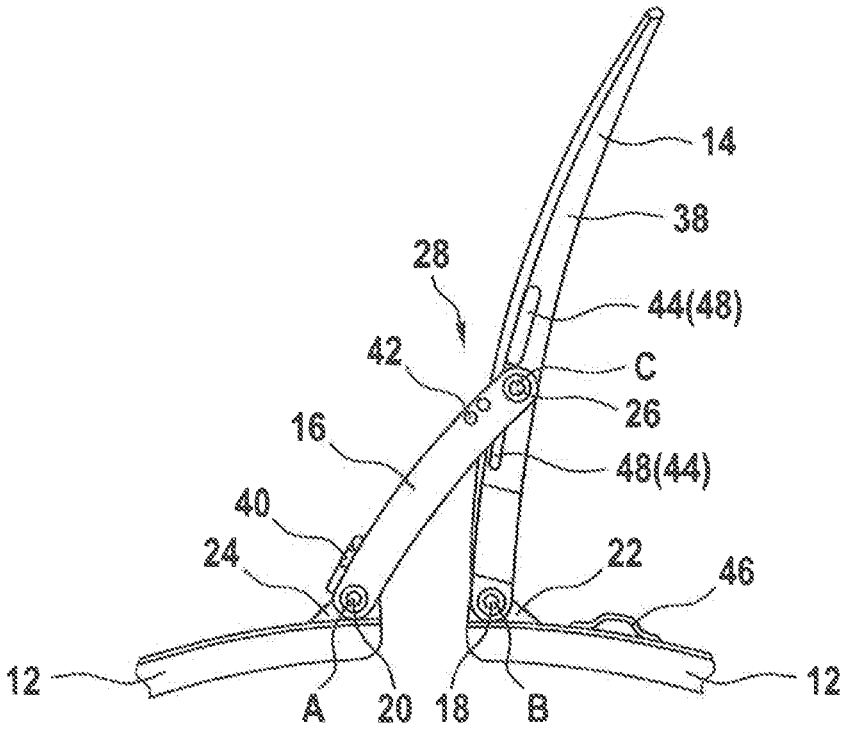
Figure 3:
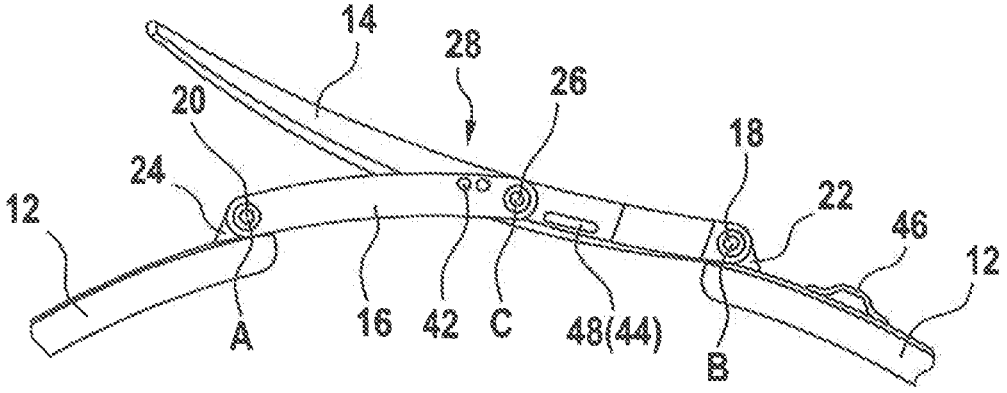
Figure 4:
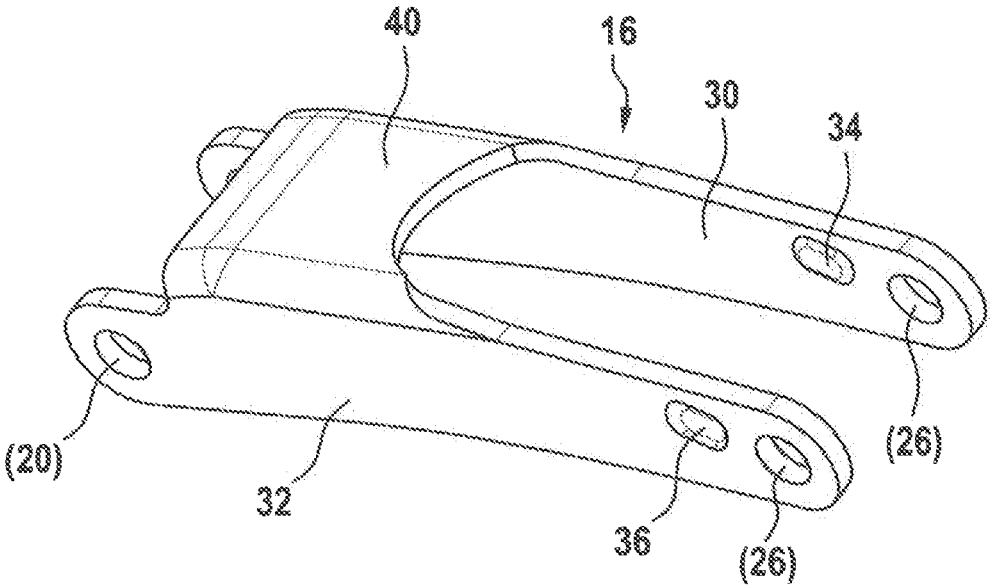
Figure 5:
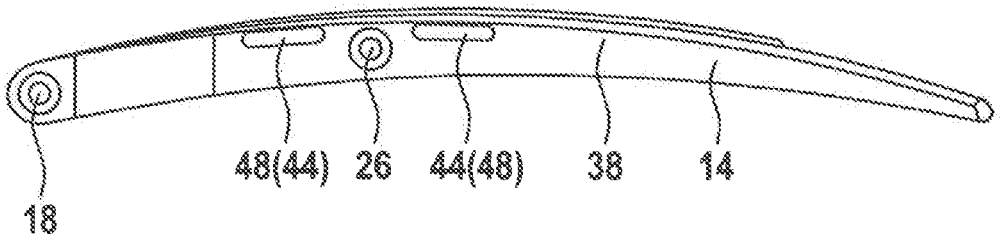
Figure 6:
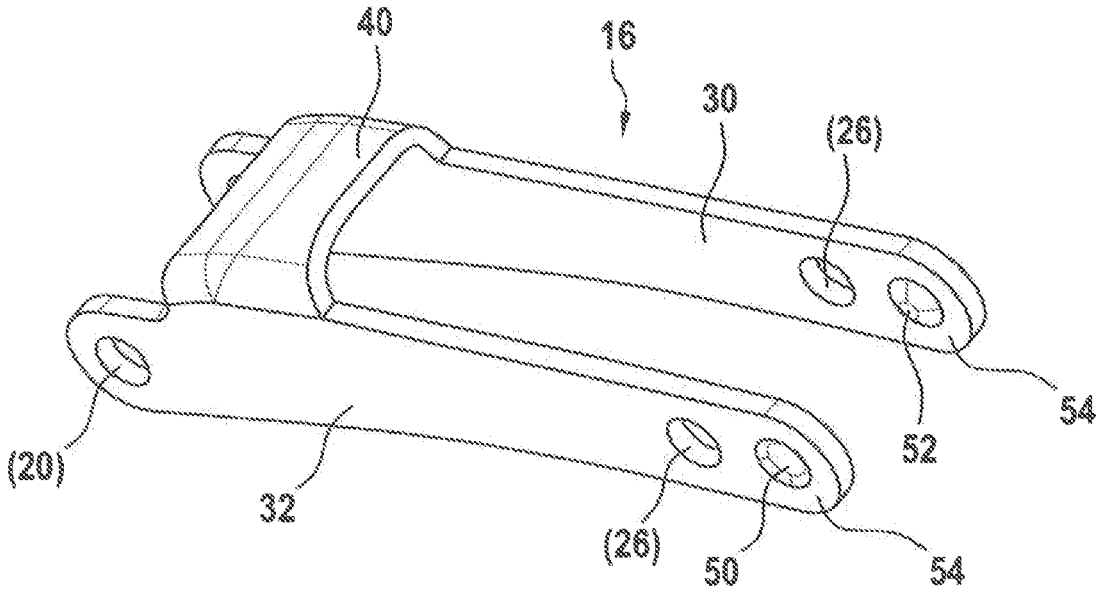
Figure 7:
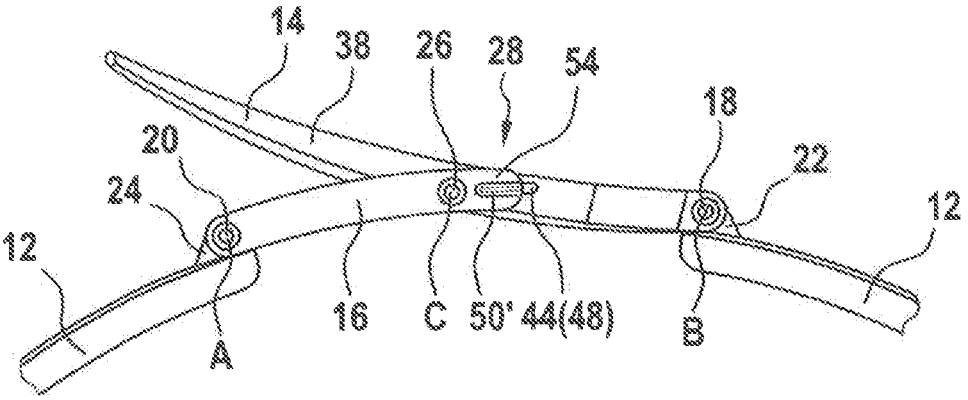
Figure 8:
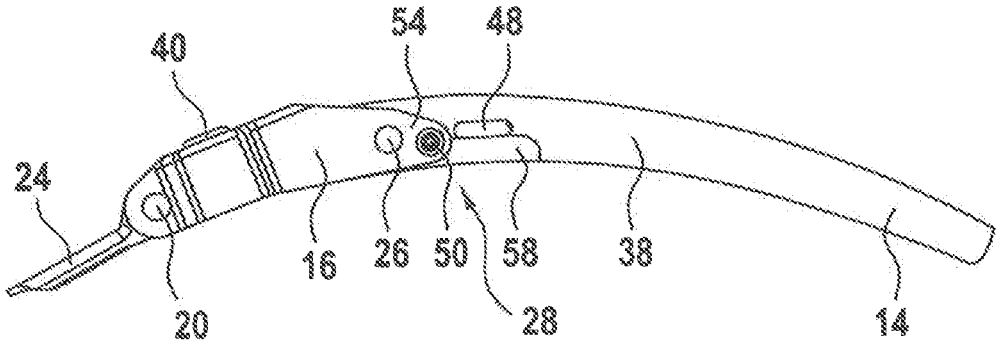
Figure 9:
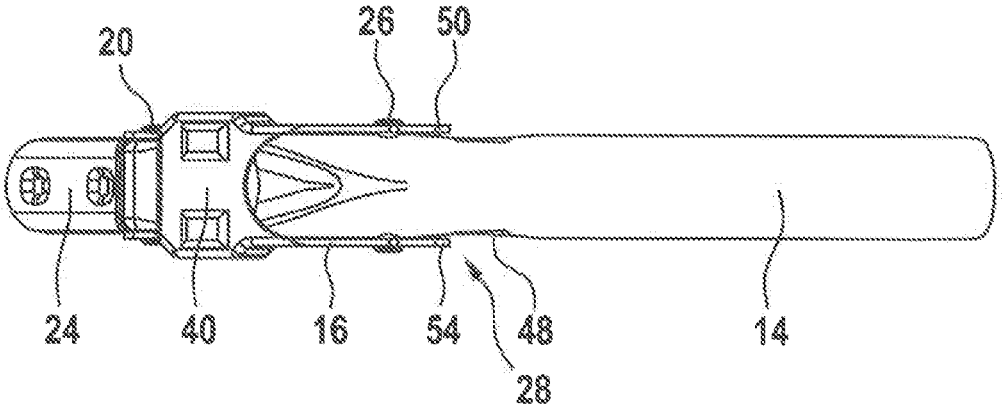
Figure 10:
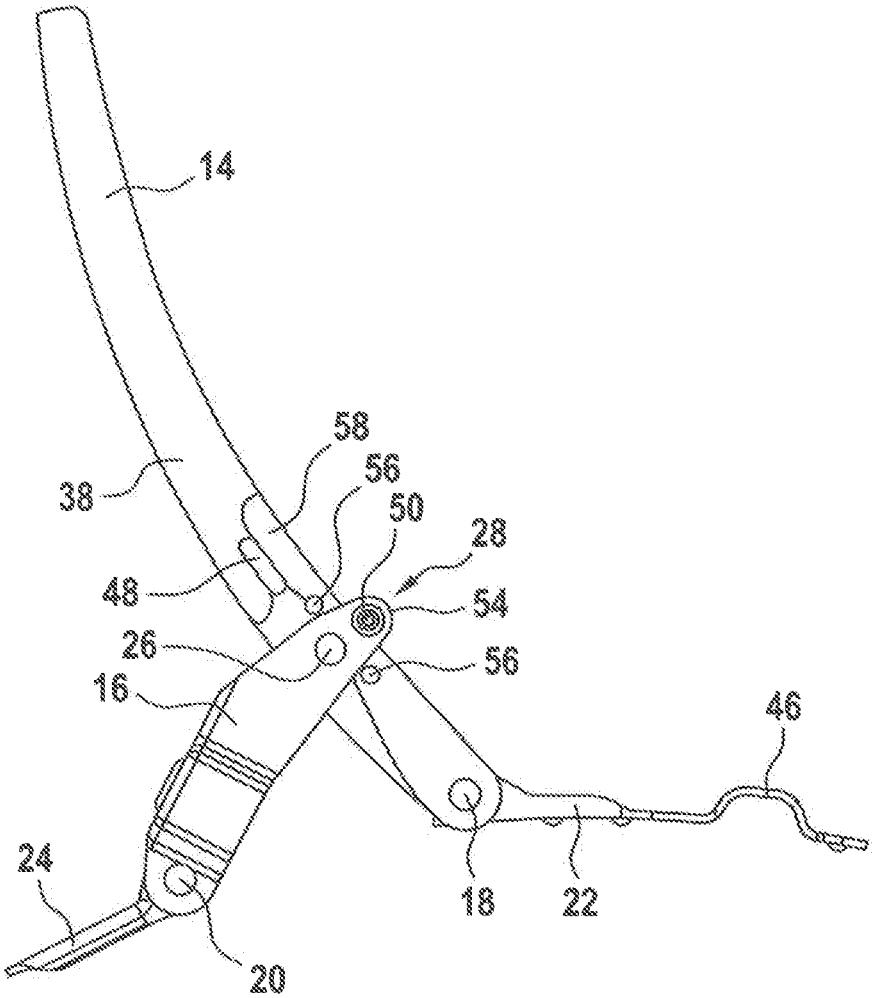
Figure 11:
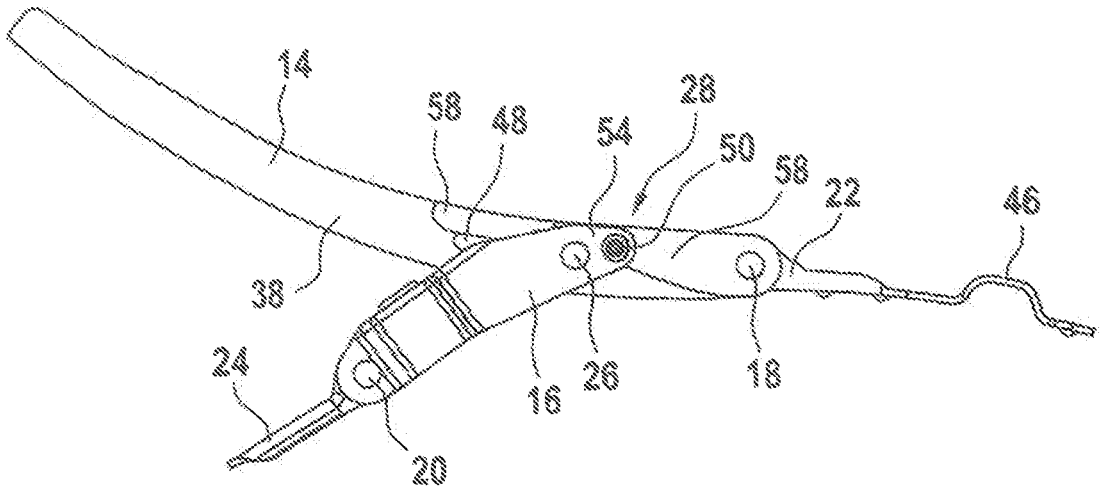

The invention is explained and described in more detail below with reference to examples of embodiments shown schematically in the drawings, wherein FIG. 1 shows a closing ring with a closing ring closure according to the invention in side view, FIG. 2 shows an opened closing ring closure in side view, FIG. 3 shows a closing ring closure according to FIG. 2 in fully open position in side view, FIG. 4 shows a one-piece traction bracket of a closing ring closure, FIG. 5 shows a closing lever in side view, FIG. 6 shows another one-piece traction bracket of a closing ring closure, FIG. 7 shows another closing ring closure in fully open position in side view, FIG. 8 shows a further closing ring closure according to the invention with closed closing lever in side view, FIG. 9 shows a top view of the closing ring closure according to FIG. 8, FIG. 10 shows the closing ring closure according to FIG. 8 with half opened closing lever in side view and FIG. 11 shows the closing ring closure according to FIG. 8 with almost fully opened closing lever in side view.

In FIG. 1, reference number 10 indicates a closing ring closure device for a closing ring 12 according to the invention. The main elements of the closing ring closure device 10 are a closing lever 14 and a traction bracket 16.

Such closing rings are used, for example, to seal lidded drums. The drum lids are usually made of plastic or metal, while the drum bodies can also be made of plastic, metal or wound kraft paper (fiber drums, cardboard drums). The closing rings are made of galvanized steel sheet profile and can have diameter sizes from 80 mm to 2000 mm with material thicknesses between 0.5 mm to 2.5 mm. Standard diameters range from 100 mm to 800 mm. In cross-sectional view, the closing rings have a flared U-shaped or trapezoid-shaped profile with or without a collar-shaped flange edge. The closing rings can be formed with a short overlap, long overlap or without overlap below the closing ring closure device.

As can be seen in FIG. 2, the main elements closing lever 14 and traction bracket 16 are both pivotably mounted on a respective closing ring-side pivot bearing base 22, 24 by means of pivot bearings 18 (B), 20 (A), with the traction bracket 16 and the closing lever 14 being pivotably connected to one another by means of a further common pivot bearing 26 (C). Thus, as a prefabricated component unit, the closing ring closure device 10 consists of four individual components 14, 16, 22, 24, which are pivotably connected to each other by means of three pivot bearings 18 (B), 20 (A), 26 (C). The closing ring closure device 10 bridges the two ends of the closing ring 12, with the closing ring-side pivot bearing base 22 of the closing lever 14 being firmly welded onto one end of the closing ring 12 and the closing ring-side pivot bearing base 24 of the traction bracket 16 being firmly welded onto the other end of the closing ring 12. When the closing ring closure device 10 is in closed position, the closing lever 14 rests flat on the closing ring 12. In this case, a sealing eyelet 46 arranged on the closing ring 12 is covered by a slotted hole 44 arranged in the side walls 38 of the closing lever. To ensure tamper-evidence, a sealing tongue or wire can be passed through the slotted holes 44 on both sides and the sealing eyelet 46, the integrity of said sealing tongue indicating an originally sealed lid.

The shown closing ring closure 10 is in the normally open position, in which the closing lever 14 usually remains in a tension-free position at 90°, projecting approximately at right angles from the closing ring 12.

According to the present invention, the closing ring closure 10 is provided with a locking device 28 in the vicinity of the common pivot bearing 26 of the closing lever 14 and the traction bracket 16, said locking device 28 in the present embodiment being formed as a snap-fit device with a latching element 42 and a snap element 44 between the traction bracket 16 and the closing lever 14. The latching element 42 can be arranged either on the traction bracket 16 or on the closing lever 14, and the snap element 44 can be arranged correspondingly opposite on the closing lever 14 or on the traction bracket 16. In the present case, the aforementioned slotted hole 44 also serves as a snap element when the closing lever 14 is in the open position. A latching-element 42 is formed by two round indentations arranged side by side which are pressed into the outer flanks of the traction bracket 16 from the outside, said indentations forming on the inside protruding latching cams on the traction bracket flanks.

Accordingly, the special design feature of this closing ring closure 10 is that the snap-fit device snaps into a wide-open position of the closing lever 14 in a coordinated functional mode between the closing lever 14 and the traction bracket 16 and fixes the closing lever 14—with respect to the pivot bearing base 22 on the closing lever side—in a wide-open position at an opening angle of greater than 90°. In the process, the latching cam latching elements 42 snap into the slotted hole snap elements 44

This wide-open position of the closing ring closure 10 with the latching cam latching elements 42 latched into the (not visible) slotted hole snap elements 44 is shown in FIG. 3. Another slotted hole 48 is provided in the closing lever 14 between the common pivot bearing 26 and the closing ring-side pivot bearing 20. This slotted hole 48 is of importance only when the closing lever 14 is closed. When the closing lever 14 is closed, the latching cam latching elements 42 snap into this slotted hole 48 respectively snap element and, as an advantageous effect, provide an additional fixation for the closing lever 14 in the closed state. Basically, the latching elements 42 have the same distance from the pivot bearing 26 as the snap elements 44.

Fixing the closing lever 14 in a wide-open position relative to the traction bracket 16 makes the closure device 10 a stable component unit which is much easier to handle during closing ring production. For mass production in series, the prefabricated closure device is now inserted as a stable component unit in a defined spread-out form into a corresponding grid-like holding frame for storage and transport in large quantities. These holding frames are then transported to an automatic welding machine, where they are fed to a supply magazine so that a spread-out or wide-open closure device, which is taken individually therefrom by a gripper of the automatic welding machine, is automatically placed on a closing ring closure device blank, that is fed from another side, and automatically welded onto it. The finished closing rings with welded-on closure device are then stored in the wide-open state in another frame and transported to an intended position at an automatic lidded drum closing machine. There, a drum lid is placed on each lidded drum body by machine and a finished wide-open closing ring is placed over the edge of the drum lid and clamped shut, thus automatically closing the lidded drum.

FIG. 4 shows an enlarged view of another traction bracket 16 of a closing ring closure device 10 according to the invention, in which the outer flanks 30, 32 are connected by a center piece 40. In the outer flanks 30, 32 of the one-piece traction bracket 16, two elongated recesses 36 are formed on the outside, which produce protruding rib-like latching cams 34 on the inside of the traction bracket flanks 30, 32. These rib-like latching cams 34 represent the latching elements of the snap-fit device for the closing ring closure device 10. When the closing lever 14 is in wide open position, the rib-like latching cams 34 snap into the corresponding slotted holes 44 or snap elements in the side walls 38 of the closing lever 14 and fix the two components against each other.

FIG. 5 shows another enlarged side view of the closing lever 14 with the two slotted holes 44, 48 and the two pivot bearings 18 and 26. As mentioned, when the closing lever 14 is fully open, the latching elements or latching cams 34 snap into the snap elements or slotted holes 44 and, when the closing lever 14 is fully closed, said latching elements or latching cams 34 snap into the snap elements or slotted holes 48.

In the case of heavier closing rings 12 for larger lidded drums, the closing ring closure devices 10 are no longer provided with two separate sheet-metal strip-like traction brackets, but are equipped with a one-piece traction bracket 16 in which the two parallel, opposing sheet-metal strip-like outer flanks 30, 32 are interconnected via the common center piece 40. The following detailed descriptions of the constructional design of a one-piece traction bracket 16 should of course also apply to two-piece traction brackets.

In the preferred embodiment of the invention, the traction bracket 16 is extended by a short piece behind the pivot bearing 26 on the closing ring side (=pivot bearing C). This short part of an extension 54 is approximately as long as the height of the outer flanks 30, 32 of the traction bracket 16, i.e. in the specific case the extension 54 has a length of between 8 mm and 36 mm, preferably 12 mm. The length of the extension should be designed just long enough to ensure elastic behavior of the snap-fit device and to exclude plastic bending of the extension.

FIG. 6 shows an example of such a traction bracket 16, in which the outer flanks 30, 32 behind the pivot bearing 26 are each provided with the extension 54. An indentation 50 is stamped onto each outer side of the extension 54, which forms an inwardly directed protrusion 52 on the inner side of the extension 54. In the present case, this inwardly directed protrusion 52 is formed as a round latching cam and represents the latching element corresponding to a snap element (round hole, slotted hole) formed on the outside of the closing lever 14.

Basically, a protrusion (34, 52) or a latching cam or lobe projecting by about 0.5 mm to 1.5 mm is regarded as the latching element and a corresponding recess (44, 48, 56) such as a slotted hole, round hole, groove, slot, elongated depression or indentation is regarded as the snap element, which, in interacting, result in a snap-fit device.

FIG. 7 shows another closing ring closure 10 in fully open position. Here, the required locking device 28 is formed as a snap-fit device between the extension 54 of the traction bracket 16 and the closing lever 14, with the latching element being formed as a rib-like protrusion on the extension 54 and snapping into the slotted hole 44 provided on the outside of the closing lever 14 as a snap element. The rib-like protrusion (not visible here) is formed by the likewise rib-like indentation 50. In this arrested fully open position, the closing lever 14 has an opening angle towards the closing lever-side closing ring end of between 90° and 180°, preferably about 160°.

When the closing ring closure device is closed, respectively when the closing ring is closed, the closing lever rests on the closing ring and the three pivot bearings lie almost in an arc line running along the circumference of the closing ring, with the pivot bearing positioned on the pivot bearing base of the closing lever between the other two pivot bearings (A-B-C). When the closing ring closure device is fully open, respectively when the closing ring is open, the back of the closing lever rests almost on the center piece of the traction bracket and the three pivot bearings again lie almost in an arc line, with the common pivot bearing of closing lever and traction bracket now being positioned between the pivot bearing on the pivot bearing base of the closing lever and the pivot bearing on the pivot bearing base of the traction bracket (A-C-B).

FIG. 8 shows a side view of a preferred embodiment of the present invention, a closing ring closure 10 according to the invention provided for series production with a closed closing lever 14. The articulated connection between closing lever 14 and traction bracket 16 is provided by the common pivot bearing 26. On the side of the traction bracket 16 facing away from the closing lever 14, the pivot bearing 20 on the closing ring side is arranged with the associated pivot bearing base 24 of the traction bracket 16. The pivot bearing on the closing ring side and the associated pivot bearing base of the closing lever 14 are arranged below the traction bracket 16 and are not visible here. On the side of the traction bracket 16 facing the closing lever 14, the extension 54 is formed in the vicinity of the pivot bearing 26, in which the round indentation 50 with protrusion 52 on the inside (not visible here) is stamped or embossed. In the side wall of the closing lever 14, the slotted hole 48 for inserting a seal for the closing ring closure in the closed position is visible. Below the slotted hole 48, a tapering 58 of the closing ring 14 extending to the pivot bearing 18 on the closing ring side can be seen.

FIG. 9 shows a top view of the closing ring closure 10. Here, the extension 54 of the traction bracket 16 beyond the pivot bearing 26 in the direction of the closing lever 14 is visible. At each end of the extension 54, the indentations 50 are embossed, which snap with their inner protrusions 52 into the corresponding snap elements or round holes 56. It is convenient to integrate a total of four such round holes 56 in the side walls of the closing lever 14 on both sides of the pivot bearing 26, as can be seen in FIG. 10, which shows the closing ring closure with the closing lever 14 half open. The round holes 56 in the closing lever 14 are arranged at the same distance from the pivot bearing 26 as the distance of the indentations 50 respectively protrusions 52 on the inside of the extension 54 of the traction bracket 16.

When the closing lever 14 is closed (cf. FIG. 8), the inside protrusions 52 of the extension 54 of the traction bracket 16 are seated in the round holes 56 next to the slotted hole 48, and when the closing lever 14 is fully open, the inside protrusions 52 (latching cams) are seated in the round holes 56 between the pivot bearing 26 and the pivot bearing 18 of the closing lever 14. As an additional advantage, this ensures a snap-fit arrangement for both end positions of the closing lever 14, namely locking respectively fixing the closing lever 14 in the open or in the closed position.

In FIG. 11, the open position of this closing ring closure 10 is shown once again in side view. Here, the protrusion 52 on the inside of the extension 54 is snapped into the round hole 56, which is arranged between the two pivot bearings 26, 18 of the closing lever 14. As a constructive novelty, this closing ring 12 with closing ring closure device 10 according to the invention is characterized by the fact that, when the closing ring closure device 10 is fully opened and fixed in position, the closing ring 12 has—compared to the closed position—an at least 5% enlarged, rigidly persisting diameter without manual holding of the closing lever 14. Fully opened closing rings have, e.g. for a 220 l lidded drum, a closing ring diameter of up to 635 mm and can be stored and transported in the open state in a magazine, e.g. to an automatic filling system for lidded drums with subsequent lidded drum closing system for automatically placing and closing the closing rings on the drum lids and lidded drums.

REFERENCE NUMBERS

10 closing ring closure device (12)
12 closing ring
14 closing lever (10)
16 traction bracket (10)
18 pivot bearing B (14)
20 pivot bearing A (16)
22 pivot bearing base (14)
24 pivot bearing base (16)
26 pivot bearing C (14, 16)
28 locking device 28 (14, 16)
30 outer flank (16)
32 outer flank (16)
34 latching cams (30,32)
36 recess (38)
38 side wall (14)
40 center piece (16)
42 latching element (16)
44 snap element (38, 14)
46 sealing eyelet (12, 22)
48 slotted hole (38, 14)
50 indentation (16)
52 protrusion (16, 30, 32)
54 extension (16, 30, 32)
56 round hole resp. bore (14)
58 tapering (14)

The invention claimed is:

1. A closing ring closure device for a closing ring, having a closing lever and a one-piece or two-piece traction bracket, each of which are pivotably mounted by means of pivot bearings on a pivot bearing base on an end of each closing ring side, wherein the traction bracket and the closing lever are pivotably connected to one another by means of a further pivot bearing, wherein two components, the closing lever and the traction bracket are provided with constructive means which are designed in a mutually coordinated functional mode between the two components as a snap-fit device for fixing the closing ring closure device in a wide open closing lever position.

2. The closing ring closure device for a closing ring according to claim 1, wherein as constructive means the closing lever or/and the traction bracket are provided with a special locking device which fixes the closing lever in a wide-open position at an opening angle of greater than 90° relative to the closing ring.

3. The closing ring closure device for a closing ring according to claim 1, wherein the locking device is designed as the snap-fit device with a snap element and a latching element, wherein the snap element is arranged either on the traction bracket or on the closing lever and the latching element is arranged correspondingly opposite on the closing lever or on the traction bracket.

4. The closing ring closure device for a closing ring according to claim 1, wherein the traction bracket has two parallel outer flanks facing each other, each of which is provided on its inner side with at least one protrusion directed towards the opposite outer flank and latching into a corresponding notch or recess in an outer side of a side wall of the closing lever when the closing lever is in wide open position.

5. The closing ring closure device for a closing ring according to claim 1, wherein the two parallel, opposing outer flanks of the traction bracket are interconnected via a common center piece and are formed as a one-piece component.

6. The closing ring closure device for a closing ring according to claim 1, wherein the snap-fit device arranged between the traction bracket and the closing lever is designed in such a way that, when the closing lever is in the wide-open position, the snap element engages with the latching element, wherein the closing lever is fixed against the traction bracket at an opening angle of greater than 160° relative to the closing ring.

7. The closing ring closure device for a closing ring according to claim 1, wherein the traction bracket has short extensions on both sides beyond the pivot bearing C common to the closing lever, and that said extensions each have indentations on the outside and, respectively, protrusions on the inside pointing inwards, wherein in side walls of the closing lever corresponding recesses are provided on both sides, into which the protrusions can be snapped and latched opposingly (vis a vis) in a locking manner when the closing lever is in wide open position.

8. The closing ring closure device for a closing ring according to claim 1, wherein the closing lever has on its side opposite the pivot bearing C corresponding recesses on both sides—at the same distance from the pivot bearing C as the inwardly pointing protrusions on the extension of the traction bracket—has on its side opposite the pivot bearing C corresponding recesses on both sides such that the protrusions can be snapped and latched into the corresponding recesses in a locking manner for the closing lever when the closing lever is in a completely closed position.

9. The closing ring closure device for a closing ring according to claim 1, wherein the closing lever, when the closing ring closure device is in the wide-open and fixed position, has an opening angle—between the closing lever and a closing ring end on the closing lever side—from the completely closed position to the wide-open opening position of between 90° and 180°, preferably approximately 160° relative to the closing ring.

10. A closing ring with a closing ring closure device according to claim 1, wherein the closing ring, when the closing ring closure device is in fully opened and fixed position, has—compared to the closed closing ring closure device—a rigidly persisting diameter enlarged by at least 5% without manual holding of the closing lever.

* * * * *